United States Patent [19]

Rechin et al.

[11] 4,234,336

[45] Nov. 18, 1980

[54] METHOD OF CHARGING A CRUCIBLE

[75] Inventors: Francis J. Rechin, Chagrin Falls; Edward J. Vargo, Massilon, both of Ohio

[73] Assignee: TRW Inc., Cleveland, Ohio

[21] Appl. No.: 12,318

[22] Filed: Feb. 15, 1979

[51] Int. Cl.[3] ..... C22B 23/00

[52] U.S. Cl. ..... 75/65 R; 75/10 R; 75/82

[58] Field of Search ..... 75/65, 43, 44 R, 44 S, 75/10 R, 135, 20 R, 0.5 R, 82; 266/280, 282, 200

[56] References Cited

U.S. PATENT DOCUMENTS

| | | | |
|---|---|---|---|
| Re. 28,382 | 4/1975 | King | 266/200 |
| 3,107,166 | 10/1963 | Behr | 75/65 R |

*Primary Examiner*—M. J. Andrews

[57] ABSTRACT

In inserting a bar of metal into a refractory crucible of a conventional vacuum furnace, a covering is placed over the leading end of the bar to reduce scoring of the crucible and the production of chips or particles of refractory material. The covering is softer than the refractory crucible and has shock absorbing properties. The covering is disintegrated upon heating of the bar and turns into constituent components which have no adverse effect on the chemical composition of the molten metal to be poured from the crucible. In the preferred practice the covering is a preformed boot which fits the leading end of the bar and is formed of an expanded unsaturated aliphatic or substituted aliphatic hydrocarbon polymer such as expanded polyethylene.

6 Claims, 2 Drawing Figures

METHOD OF CHARGING A CRUCIBLE

BACKGROUND OF INVENTION

The present invention relates to a method and apparatus for use when inserting a bar of metal into a crucible. In particular, the present invention relates to a method of reducing the production of chips of refractory material as a metal bar is inserted into a receptacle formed of a refractory material.

Melting of high temperature nickel or cobalt base alloys in a vacuum furnace requires the use of a refractory crucible to contain the molten metal. A bar of metal having the desired composition is inserted into the crucible either manually or by using a machine. During the process of inserting the bar of metal into the crucible, chips of refractory material may be produced. These chips may be produced either by sliding, abrasive contact between the leading end portion of the bar and the side of the crucible or by shock to the crucible when the leading end portion of the bar reaches the bottom of the crucible. The chips of refractory material are undesirable because they become suspended in the molten metal, enter a mold cavity, and ultimately form detrimental inclusions in an otherwise acceptable casting.

SUMMARY OF THE INVENTION

The present invention provides a new and improved method and apparatus for use when inserting a metal bar into a refractory receptacle or crucible whereby the production of refractory chips is substantially reduced. Prior to inserting the bar into the crucible, the leading end portion of the bar is covered with a boot. The boot is formed of a material which is softer than the material of which the crucible is made. Therefore there is little or no scratching or scoring of the crucible side walls as the bar is inserted, and therefore there are many fewer chips of refractory material produced. Further the boot has shock absorbing qualities so that shock to the crucible caused by abrupt contact between the leading end of the bar and the bottom of the crucible is reduced.

Once the bar is in place in the crucible, the boot is thermally decomposed. The boot is formed of a material which will decompose upon the application of heat into constituent parts which are not detrimental to the metal being melted.

Accordingly, it is an object of the present invention to provide a new and improved method and apparatus for use when inserting a metal bar into a crucible to prevent scoring and chipping of the crucible are reduced.

It is a further object of the present invention to provide a method and apparatus as set forth in the preceding object and in which the leading end portion of the metal bar is covered with a boot formed of a material which is softer than the material of which the crucible is formed and which has shock absorbing qualities.

It is a further object of the present invention to provide a method and apparatus as set forth in the preceding object in which the boot is formed of a material which can be thermally decomposed into constituent parts which are not detrimental to the metal being melted.

BRIEF DESCRIPTION OF THE DRAWINGS

The foregoing and other objects and features of the present invention will become more apparent upon a consideration of the following description taken in connection with the accompanying drawings wherein.

DESCRIPTION OF PREFERRED EMBODIMENTS

Figure 1:
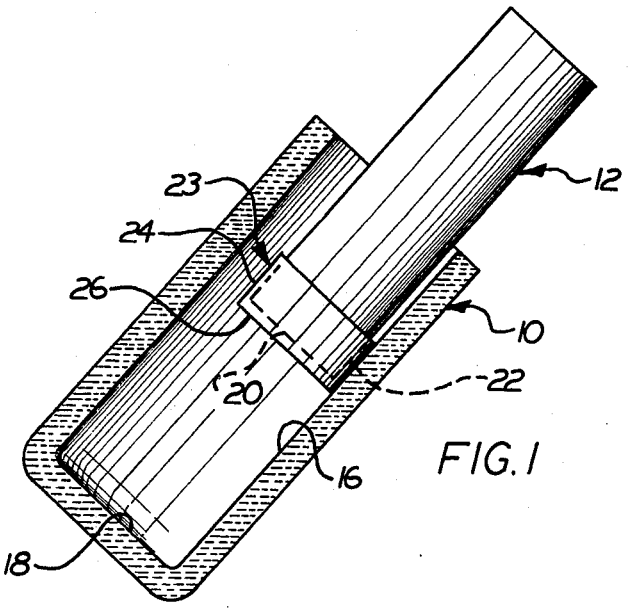
FIG. 1 is a sectional view of a refractory crucible in which a metal bar fitted with a boot is being inserted.

FIG. 1 illustrates a refractory crucible 10 of a conventional vacuum furnace (not shown) into which a charge bar 12 of metal to be melted is being inserted. The vacuum furnace may be constructed in a manner similar to the furnace disclosed in U.S. Pat. No. 3,900,064. The crucible 10 may have a refractory liner and be associated with an induction type heater as disclosed in U.S. Pat. No. 3,401,227.

When the bar 12 is inserted, the crucible 10 may be at room temperature or it may be as hot as several hundred degrees Fahrenheit due to the residual heat from previous heating. Once the bar 12 is in the crucible, atmospheric gases are evacuated from the crucible and the bar is heated until it melts, about 3000° F. In order to withstand the heat inside the furnace and to contain the molten metal the crucible 10 is formed of a refractory material such as zirconia, silica, alumina, or any other suitable refractory material.

In the past the process of inserting the bar 12 into the crucible 10 has produced chips or fragments of refractory material which contaminate the metal when it is melted. The bar 12 is formed of a nickel or cobalt based alloy and has a specific, predetermined weight and composition which are dependent upon the casting to be made. The bar 12 is heavy and difficult to maneuver, and whether it is inserted into the crucible 10 by hand or by using power lifting equipment, abrasive, sliding contact between the leading end portion 22 of the bar and the side wall 16 of the crucible is almost unavoidable.

Contact between the bar 12 and the crucible 10 as the bar is inserted can cause scoring or chipping of the crucible, and this is in turn produces the particles or fragments of refractory material which contaminate the molten metal. In addition, if the bar 12 is not lowered gently into the crucible 10, abrupt contact between the end face 20 of the bar and the bottom 18 of the crucible could jar additional chips or fragments loose.

To reduce the possibility that chips will be produced as the bar 12 is inserted into the crucible 10, the leading end portion 22 of the bar is fitted with a boot 23. The boot 23 is formed of a material which is softer than the refractory material of which the crucible 10 is formed. In addition, the material of which the boot 23 is formed has qualities which reduce thermal and mechanical shock effects when the bar 12 reaches the bottom 18 of the crucible 10. Reducing the chips of refractory material produced during charging of the crucible 10 by using the boot 23 reduces the liklihood that a casting of metal poured from the crucible will contain inclusions of refractory material which would render an otherwise satisfactory casting unusable.

Figure 2:
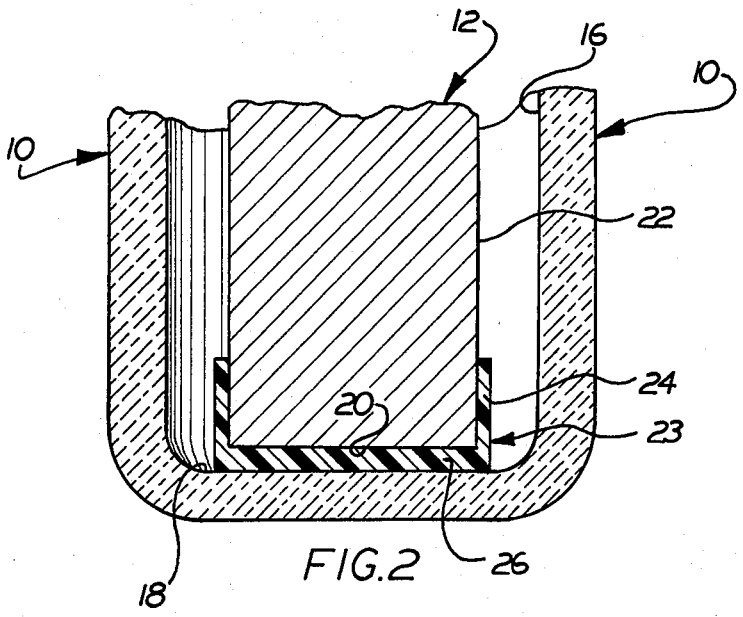
FIG. 2 is a sectional view of a portion of the crucible shown in FIG. 1 and showing the bar and the boot when the bar is fully in the receptacle.

The boot 23 (FIG. 2) is adapted to tightly engage the leading end portion 22 of the bar 12. The bar 12 is generally cylindrical, and therefore the boot 23 has a generally cyllindrical tubular sidewall 24 which tightly engages the bar 12. When the bar 12 with the boot 23 is inserted into the crucible 10, the sidewall 24 of the boot is abraded by the crucible instead of the crucible being abraded by the bar, and few, if any, chips of refractory material are removed from the sidewall 16 of the crucible. The sidewall 24 of the boot 23 is sufficiently thick so that by the time the bar 12 is fully within the crucible 10, at least a portion of the original sidewall thickness remains intact.

The boot 23 includes a circular bottom 26 which is disposed in abutting engagement with the circular end face 20 of the bar. As noted above the boot 23 is formed of a shock absorbing material. The bottom 26 of the boot 23 is sufficiently thick to absorb any reasonably anticipated impact between the bar 12 and the crucible bottom 18.

Once the bar 12 is in the crucible 10 (FIG. 2) and the atmospheric gases have been evacuated, the bar is heated. Heating the bar 12 causes disintegration of the boot 23. The constituents of the boot 23 which are volitalized are withdrawn from the crucible by the vacuum. Those constitutents which do not volatilize until above the melting temperature of the bar 12 dissolve in the molten metal. Thus, it is important that the non-volatile constituents of the boot 23 be chemically compatible with the metal of which the bar 12 is made.

A material which is suitable for forming the boot 23 is polyethylene which has been expanded thermally or by foaming. This material is softer than the refractory material of which the crucible 10 is formed, and it is sufficiently shock absorbing to cushion impact as the bar 12 reaches the bottom 18 of the crucible 10. In addition, when polyethylene is heated to metal treating temperatures under a vacuum, it readily depolymerizes and may decompose into hydrogen and carbon or both.

The polyethylene of the boot 23 is fugitive when heated. If it depolymerizes, the ethylene gas is drawn off by the vacuum. If the polyethylene decomposes, the hydrogen is drawn off in the vacuum and the carbon is dissolved in the molten metal. Although the carbon is dissolved in the molten metal and eventually becomes part of the crystal structure of the casting, there is such a small amount of it relative to the size of the bar 12 that it has no significant effect on composition or structural properties of a casting poured from the metal in the crucible 10.

The boot 23 has been described as being formed of polyethylene. However, this is not to be construed of a limitation on the scope of the invention herein disclosed. It is contemplated that the boot could be formed of any unsaturated aliphatic, or unsaturated substituted aliphatic hydrocarbon polymer having fewer than 10 carbon atoms per monomer unit, preferably an unsaturated alkylene polymer in which the monomer contains fewer than four carbon atoms. Examples of such a polymer are polyethylene, polypropylene, polystyrene, etc. In addition, these polymers may be homopolymers or copolymers of monomer units of different carbon atom content. For example, ethylene-propylene copolymers.

The bar 12 has been shown and described as being cylindrical. However, it is obviously within the scope of the present invention to provide a bar which has any desired cross section. In such a case the side wall 24 and bottom 26 of the boot 23 would be shaped to conform to the shape of the bar.

Further, the crucible 10 has been shown in FIG. 1 as being tilted as the bar 12 is inserted into it. However, it is clear that this need not be so, and that the boot 23 could be advantageously used regardless of the orientation of the receptacle 10.

Finally, although the boot 23 is preformed, it is contemplated that the material of which the boot is formed could be attached to the bar 12 in other ways. For example, the material could be sprayed onto the end portion 22 of the bar 12.

What is claimed is:

1. A method of charging an empty crucible having a refractory wall with a bar of metal, said method comprising the steps of covering only one end portion of the bar with a material which is softer than the material of which the crucible is formed and which has no substantial adverse effect on the chemical composition of the molten metal to be poured from the crucible, inserting the bar into the empty crucible with the one end portion of the bar leading to enable the covering to engage the inner surface of the empty crucible before molten material is held in the crucible thereby to reduce the extend to which particles of refractory material are dislodged from the walls of the crucible as the bar is inserted, and then disintegrating the covering and melting the bar to fill the crucible with molten material.

2. A method of charging a crucible having a refractory wall with a bar of metal, said method comprising the steps of covering only one end portion of the bar with a material which is softer than the material of which the crucible is formed and which has no substantial adverse effect on the chemical composition of the molten metal to be poured from the crucible, leaving a central portion and an end portion of the bar opposite from the one end portion uncovered and exposed to the atmosphere, inserting the bar into the crucible with the central portion and opposite end portion of the bar spaced from the inner surface of the crucible and with the one end portion of the bar leading to enable the covering to engage the inner surface of the crucible thereby to reduce the extent to which particles of refractory material are dislodged from the crucible as the bar is inserted, and then disintegrating the covering and melting the bar in the crucible.

3. A method as set forth in claim 2 wherein said step of disintegrating the covering includes the step of thermally decomposing the covering at a temperature substantially below the temperature at which the bar of metal melts.

4. A method as set forth in claim 1 wherein said step of covering at least one end portion of the bar includes the step of covering the leading end portion of the bar with a pre-formed boot.

5. A method as set forth in claim 2 wherein said step of covering one end portion of the bar includes the step of covering the leading end portion of the bar with a material consisting essentially of an unsaturated aliphatic or unsaturated aliphatic hydrocarbon polymer.

6. A method as set forth in claim 2 wherein said step of covering one end portion of the bar includes the step of covering the leading end portion of the bar with a material consisting essentially of an expanded polymeric material.

* * * * *

UNITED STATES PATENT AND TRADEMARK OFFICE

CERTIFICATE OF CORRECTION

PATENT NO. : 4,234,336

DATED : November 18, 1980

INVENTOR(S) : Francis J. Rechin, et al.

It is certified that error appears in the above-identified patent and that said Letters Patent are hereby corrected as shown below:

Column 4, line 22, change "extend" to --extent--;

line 58, after "unsaturated" insert --substituted--.

Signed and Sealed this

Tenth Day of March 1981

[SEAL]

Attest:

RENE D. TEGTMEYER

Attesting Officer

Acting Commissioner of Patents and Trademarks